US009903204B2

(12) United States Patent
Kamath

(10) Patent No.: US 9,903,204 B2
(45) Date of Patent: Feb. 27, 2018

(54) MULTIPLE VANE ROTO-DYNAMIC VARIABLE DISPLACEMENT KINETIC SYSTEM

(71) Applicant: Das Ajee Kamath, Pimpri Pune (IN)

(72) Inventor: Das Ajee Kamath, Pimpri Pune (IN)

( * ) Notice: Subject to any disclaimer, the term of this patent is extended or adjusted under 35 U.S.C. 154(b) by 40 days.

(21) Appl. No.: 15/030,190

(22) PCT Filed: Oct. 20, 2014

(86) PCT No.: PCT/IN2014/000663

§ 371 (c)(1),
(2) Date: Apr. 18, 2016

(87) PCT Pub. No.: WO2015/075734

PCT Pub. Date: May 28, 2015

(65) Prior Publication Data

US 2016/0312611 A1 Oct. 27, 2016

(30) Foreign Application Priority Data

Oct. 18, 2013 (IN) ..... 3278/MUM/2013

(51) Int. Cl.

| | |
|---|---|
| ***F03C 4/00*** | (2006.01) |
| ***F04C 2/00*** | (2006.01) |
| ***F04C 18/00*** | (2006.01) |
| ***F01C 1/067*** | (2006.01) |

(Continued)

(52) U.S. Cl.

CPC ..... *F01C 1/067* (2013.01); *F01C 1/077* (2013.01); *F01C 20/18* (2013.01); *F01C 21/008* (2013.01);

(Continued)

(58) Field of Classification Search

CPC ..... F01C 1/067; F01C 1/077; F01C 20/18; F01C 21/008; F02B 53/00; F04C 2/067;

(Continued)

(56) References Cited

U.S. PATENT DOCUMENTS 3,565,049 A * 2/1971 Bauer ..... F01C 1/077 418/36

3,592,571 A 7/1971 Drury (Continued)

FOREIGN PATENT DOCUMENTS

DE 19948006 A1 4/2001

*Primary Examiner* — Theresa Trieu

(74) *Attorney, Agent, or Firm* — Harness, Dickey & Pierce, P.L.C.

(57) ABSTRACT

A multiple vane kinetic system produces variation in an enclosed volume between pairs of radial vane sets independent of each other and coaxial with a central axis within a annular casing that encapsulates the vane sets. The system operates in a sequence where the vane sets function as rotating links of the mechanism for a particular period, which is preceded and succeeded by another period where either vane sets successively alternate between being a fixed link and a rotating link of the mechanism and during the former period the volumes between vanes remain constant as long as the vane sets have equal angular velocities, otherwise varies at rates proportional to differing angular velocities. The two time periods are controlled by timing devices actuating vane sets to be coupled and decoupled with a power shaft and the variation in length of two time periods makes roto-dynamic variable displacement machine.

8 Claims, 4 Drawing Sheets

(51) Int. Cl.

| | |
|---|---|
| ***F01C 1/077*** | (2006.01) |
| ***F01C 20/18*** | (2006.01) |
| ***F01C 21/00*** | (2006.01) |
| ***F02B 53/00*** | (2006.01) |
| ***F04C 2/067*** | (2006.01) |
| ***F04C 14/18*** | (2006.01) |
| ***F04C 15/00*** | (2006.01) |
| ***F04C 18/067*** | (2006.01) |
| ***F04C 28/18*** | (2006.01) |
| ***F04C 29/00*** | (2006.01) |

(52) U.S. Cl.
CPC ..... *F02B 53/00* (2013.01); *F04C 2/067* (2013.01); *F04C 14/18* (2013.01); *F04C 15/0057* (2013.01); *F04C 18/067* (2013.01); *F04C 28/18* (2013.01); *F04C 29/0042* (2013.01)

(58) Field of Classification Search
CPC .... F04C 14/18; F04C 15/0057; F04C 18/067; F04C 28/18; F04C 29/0042
USPC ..... 418/33, 35, 36, 38, 259–260; 123/241, 123/245
See application file for complete search history.

(56) References Cited

U.S. PATENT DOCUMENTS

| | | | | | |
|---|---|---|---|---|---|
| 3,761,206 | A * | 9/1973 | Fierstine | F04C 14/10 | 418/16 |
| 4,068,985 | A * | 1/1978 | Baer | F01C 1/077 | 418/36 |
| 4,132,078 | A | 1/1979 | Akeret | | |
| 4,153,396 | A | 5/1979 | Landry | | |
| 5,622,149 | A | 4/1997 | Wittry | | |
| 6,158,987 | A * | 12/2000 | Raikamo | F01C 1/077 | 418/36 |
| 6,457,452 | B1 * | 10/2002 | Sakita | F02B 53/00 | 123/245 |
| 7,431,007 | B2 | 10/2008 | Kamath | | |

* cited by examiner

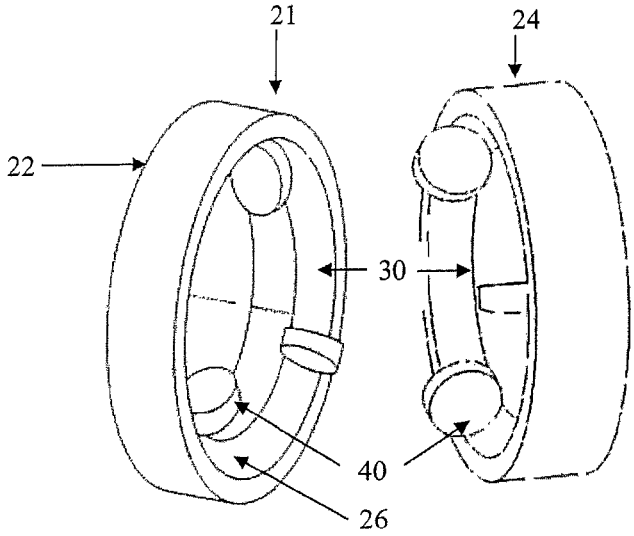
Fig5 (a)
Fig5 (b)
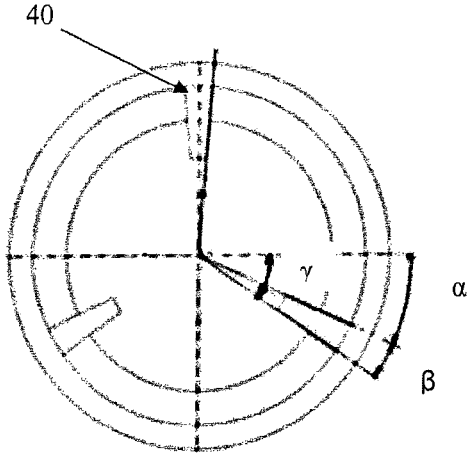
Fig5 (c)
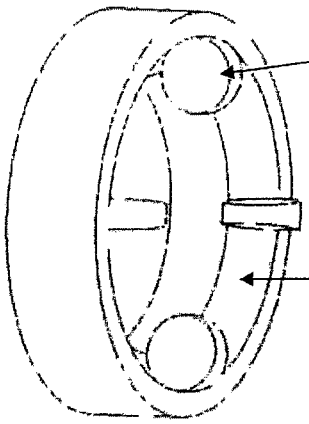
Fig6 (a)
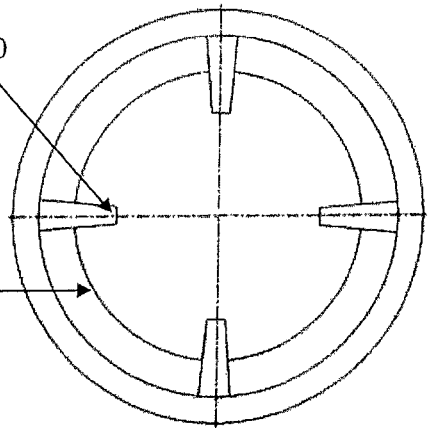
Fig6 (b)

MULTIPLE VANE ROTO-DYNAMIC VARIABLE DISPLACEMENT KINETIC SYSTEM

CROSS-REFERENCE TO RELATED APPLICATIONS

This application is a 371 U.S. National Stage of International Application No. PCT/IN2014/000663, filed on Oct. 20, 2014 and claims priority to Indian Application No. 3278/MUM/2013, filed on Oct. 18, 2013. The entire disclosures of the above applications are incorporated herein by reference.

TECHNICAL FIELD

The present invention relates to a multiple vane roto-dynamic variable displacement kinetic system with a kinematic mechanism that more particularly relates to a variable displacement kinetic system to be used in fluid handling machines such as compressors, pumps, motors, internal combustion engines or the likes.

BACKGROUND

Various rotary kinematic mechanisms and configurations based on radial vanes inside a toroid/torus chamber are known for use in fluid handling machines where the rotor and stator elements vary the volume entrapped between them. For example the concept in U.S. Pat. No. 3,592,571, U.S. Pat. No. 4,153,396, include relative motion between two or more vane elements distributed within a chamber, where the relative motion is controlled by means of external gearing or control the accelerating and retarding forces of rotor elements by frictional elements.

In many such concepts the vanes either perform back and forth motion of vanes and some others can achieve a more desired unidirectional variation in relative speeds.

U.S. patent application Ser. No. 10/553,857, discloses a rotary apparatus comprising of vanes fitted on sleeves, which are coupled and uncoupled with a shaft by means of coupling arrangement, however the single vanes per sleeve causes out of balance forces and require balancing at a different plane away from the plane of the vane inside the chamber. Similarly the torque variations through one rotation is high because of combustion occurring at a single point and once in a rotation and furthermore for correct and positive clutching and disengaging without any slipage is necessary for accurate control on magnitude of expansion and it becomes difficult as inertia increases at higher speeds.

All such mechanism discussed above have various differing drawbacks and limitations and many of these mechanisms only provide for pumping of fluids where energy is transferred to the fluids by such machine, but they are unable to perform effective motoring by fluids, wherein energy is transferred from fluids to the rotor elements.

U.S. Pat. No. 5,622,149 describes a rotary engine with radial vanes however it uses fluid bleeding arrangements for venting fluids to achieve varying expansion ratios, however these lead to loss of work and efficiency.

In fuel powered motors the size of combustion chambers is a major design factor as it influences flame travel distance, total time of combustion and heat losses through the casing surface area. These factors have direct bearing on thermal efficiencies. The centrally placed shafts in the known rotary concepts limits the reduction in 'surface area to volume ratio' of the torus and mean torus diameter and hence limiting the reduction in material and manufacturing cost and at the same time it also limits the reduction in heat loss by radiation. The degree of compactness influences the total volume and space requirements of such machine units and in many applications the higher the degree of reduction in total machine volume, for a given fluid volume, is beneficial. Similarly there are limitations in reduction in frictional losses due to limitation in improving the degree of compactness.

It would therefore be advantageous to provide an improved novel arrangement to overcome the above mentioned drawbacks and/or to provide various other benefits and advantages.

SUMMARY OF THE INVENTION

Present invention discloses a multiple vane roto-dynamic variable displacement kinetic system with a mechanism capable to overcome above mentioned limitations comprising, an intermittent rotor element containing plurality of, an individual constituents along with a counterpart and both have a circular disc placed coaxially on a central axis such that each of said individual constituents has an inner surface that together with the inner surface of said counterpart forms a first part of a torus chamber surface wherein said circular disc are fitted with plurality of overhanging, radial and concentric vanes such that each of said circular disc have equal number of said vanes, a drive element which is a continually rotating link of said mechanism when operating, and either serves as the power input member or the power take off member, at least a stator element that forms a part of a structural element to support said rotor element with its surface forming a second part of said torus chamber surface that along with said first part forms a first volume that encloses said vanes, wherein said first volume is partitioned into plurality of second volumes which is equal to the total number of vanes in said circular disc that aids in improving combustion efficiency, wherein a seam lines on the torus chamber surface formed at the end surface of said intermittent rotor element and said stator elements are provided with a sealing elements so that spaces between said vanes inside the torus chamber surface are sealed from spaces outside the torus chamber and similarly sealing arrangements on a circumferential surface of said vanes for sealing fluid leaking past the circumferential surface of said vanes providing leak proof compression, a bi-purpose coupling for engaging and disengaging said individual constituents with either said drive element, or with said structural element through said bi-purpose coupling depending upon a signal provided by a control link actuated by a first timing device, such that there is one said first timing device for each said individual constituents wherein said first timing device of said individual constituent actuates said bi-purpose coupling of said counterpart, wherein said first timing device reads the angular position of said vanes and actuates said bi-purpose coupling at a desired angular position from said counterpart for rendering said counterpart either as fixed link or as rotating link, allowing said circular discs to perform a sequence wherein said individual constituents are rotating link of said mechanism for a first period, which is preceded and succeeded by a second period wherein either of said individual constituents is alternately a part of fixed link of said mechanism, while said counterpart is rotating link of said mechanism, thus leading to alternate increase and decrease of said second volumes entrapped between said vanes, and simultaneously decreasing and increasing on both sides of said vanes respectively, keeping said second volumes constant for said first period, wherein, the changes in said second volumes are utilized for thermodynamic processes in fluid handling machines and the variation in time period of said first period and said second period by varying said desired angular position resulting in said multivane roto-dynamic variable displacement machine.

The individual constituents and said drive elements are links of rotating pairs that enable variable speed ratios between said individual constituents making them partially independent and said drive elements resulting in angular rotation of either an unequal magnitude or of an equal magnitude, thus leading to varying rate of alternate increase and decrease of said second volumes entrapped between said vanes, and simultaneously decreasing and increasing on both sides of said vanes respectively, except at times when the angular velocities of said individual constituents is of said equal magnitude and thus keeping said second volumes constant for said first period.

The drive element is either placed concentric with said coaxial axis or is non concentric, wherein when said drive element being non concentric, it is engaged to bi-purpose couplings through at least a common transmission element.

The first timing device comprises, a profiled element along with a follower that rides on a surface and reads the surface variation, one for each said individual constituents and driven by said individual constituents, wherein said profiled element has at least a projected surface with a second projected angle (γ) projected on the center of said individual constituents such that said second projected angle (γ) exceeds a first projected angle (α) which is projected by said vanes on the center of said Circular Discs, wherein said profiled element and said follower have a positional dependency with its respective said individual constituents, such that variation at said projected surfaces, which relay the position of said vanes on its said individual constituents and said positional dependency ensures that said counterpart is engaged and disengaged by its respective said bi-purpose coupling, actuated by said follower responding to variation on the said projected surface at desired said angular position of its respective said individual constituents with respect to said counterpart and the variation of said projected angle varies the point of actuation of said bi-purpose coupling, wherein displacing the follower in a direction where the variation of said second projected angle leads to said actuation of bi-purpose coupling at a position corresponding to the varied position of the second projected angle, thence resulting in mechanism working as a variable displacement machine, wherein said projected surfaces and said follower of respective said individual constituents actuate its said counterpart as many times as the number of said vanes during one rotation of said individual constituents either by said projected surface which is one for each said vanes and one follower or by one said projected surface and said follower which one for each said vanes or by such number of said projected surface and said follower that provide as many number of actuations as there are number of said vanes on its respective said individual constituents during one rotation. At least a fluid exchange accessories is fitted on elements of said mechanism for allowing fluid exchange between said second volumes and volumes outside said torus chamber surface, wherein said fluid exchange accessories comprises a second timing device with a positional dependency with its respective said individual constituents. At least an energy exchange accessories is fitted on elements of said mechanism for allowing energy exchange between said second volumes and volumes outside said torus chamber surface.

BRIEF DESCRIPTION OF DRAWINGS

FIG. 2(*b*) illustrates an exemplary embodiment of the present invention depicting sectional side view of assembly of the embodiments.

FIG. 5(*a*) illustrates an exemplary embodiment of the present invention depicting a sectional view of individual constituents with its three vanes.

FIG. 5(*b*) illustrates an exemplary embodiment of the present invention depicting a sectional view of the counterpart of individual constituents with its three vanes.

FIG. 5(*c*) illustrates an exemplary embodiment of the present invention depicting an angular separation of and between three vanes from the center of individual constituents or circular discs.

FIG. 6(*a*) illustrates an exemplary embodiment of the present invention depicting a sectional view of individual constituents with its four vanes.

FIG. 6(*b*) illustrates an exemplary embodiment of the present invention depicting an angular separation of and between four vanes from the center of individual constituents or circular discs.

Figure 1:
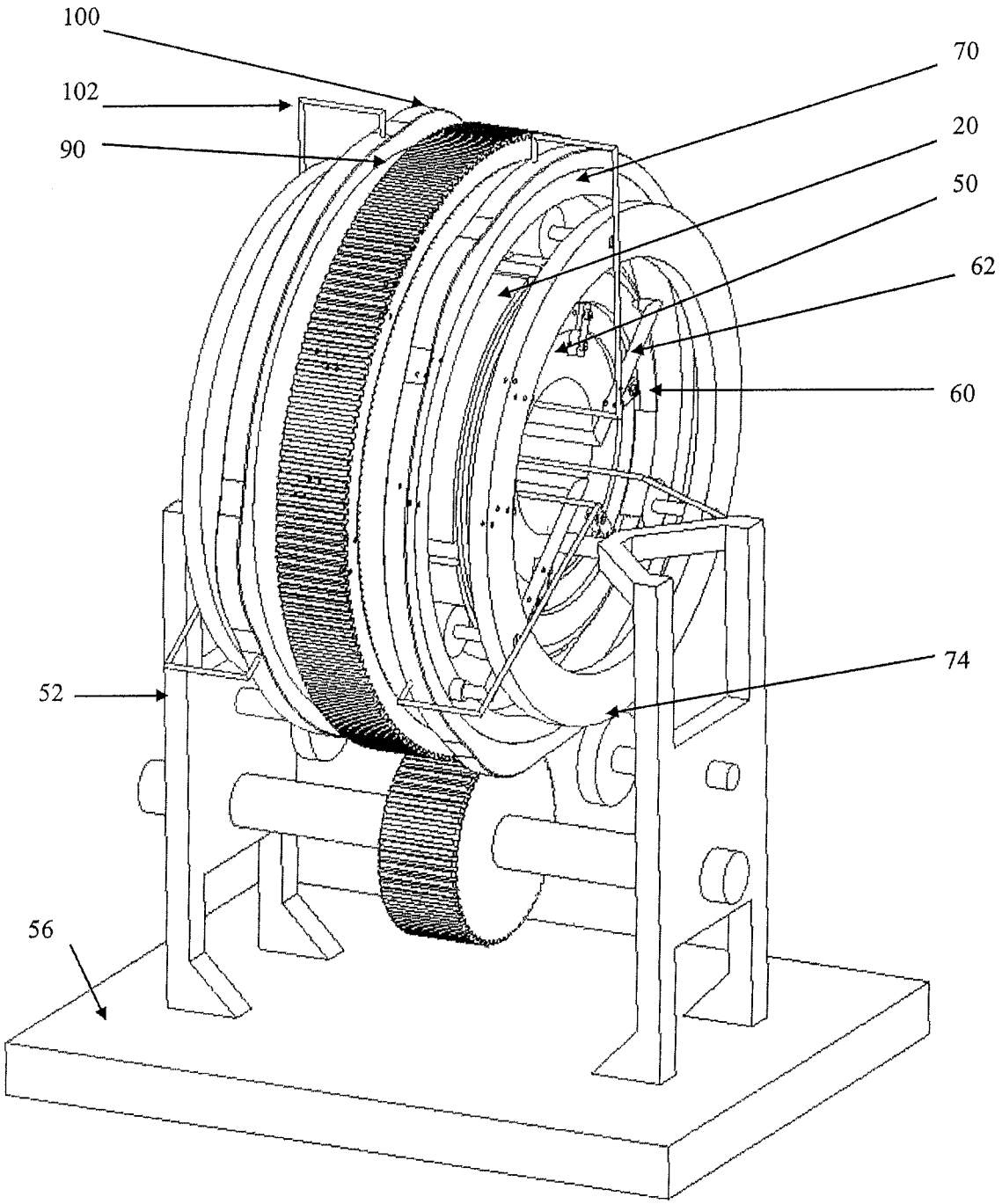
FIG. 1 illustrates an exemplary embodiment of the present invention depicting an isometric view of the assembly of the embodiments.

| Description of Elements | Reference Numeral |
|---|---|
| Intermittent rotor element | 20 |
| Individual constituents | 21 |
| Circular discs | 22 |
| Counterpart | 24 |
| Inner surface | 26 |
| First part (of Torus) | 30 |
| Second part (of Torus) | 32 |
| First volume | 34 |
| Second volume | 36 |
| Seam lines | 38 |
| Vanes | 40 |
| Sealing element | 42 |
| Stator element | 50 |
| Frame | 52 |
| Base | 56 |
| First timing device | 60 |
| Follower | 62 |
| Profiled element | 64 |
| Projected surface | 68 |
| Bi-purpose coupling | 70 |
| First gearing arrangement | 72 |
| Second gearing arrangement | 74 |
| Control link | 80 |
| Drive element | 90 |
| Second timing device | 100 |
| Actuating linkage | 102 |
| Fluid exchange accessories | 104 |
| Energy exchange accessories | 106 |
| Common transmission element | 120 |
| First projected angle | α |
| Projected angle of vane | β |
| Second projected angle | γ |

DETAILED DESCRIPTION OF INVENTION

The present invention can be fully understood by reading the following detailed description of the embodiments of a multiple vane roto-dynamic variable displacement kinetic system with a mechanism comprising the intermittent rotor element (20) and the stator element (50), The intermittent rotor element (20) contains individual constituents (21) and its counterpart (24) with circular disc (22) placed coaxially on the central axis and facing each other.

As shown in FIG. 1, the stator element (50) forms a part of the structural element to support the rotor element. The stator element (50) is at the center and is structurally supported by a frame (52) on a base (56). Rotor element is mounted to rotate on outer diameter of the stator element (50). The drive element (90) comprises the outer periphery of the common transmission element (120), which is mounted on the outer periphery of the intermittent rotor elements (20). This drive element (90) rotates continuously and is geared to outer gear and either serves as the power input member or the power take off member. The bi-purpose coupling (70) is geared on the outer periphery of the circular disc (22) which is a part of the individual constituent (21), to enable the rotation of the bi-purpose coupling (70) with the individual constituent (21) when the bi-purpose coupling (70) slides on the keys of the projected surface (68), thereby, engaging and disengaging the individual constituents (21) with either the drive element (90), or with the structural element. This engagement and disengagement is dependent on a signal provided by the control link (80) when actuated by the first timing device (60). Each said individual constituents (21) has its first timing device actuated by its counterpart (24). The first timing device reads the angular position of vanes (40) and actuates bi-purpose coupling (70) at a desired angular position such that the counterpart (24) is rendered either as a fixed link or as rotating link for particular period, which forms sequential rotating and stopping action of the vanes (40) to perform a sequence of events.

Figure 2:
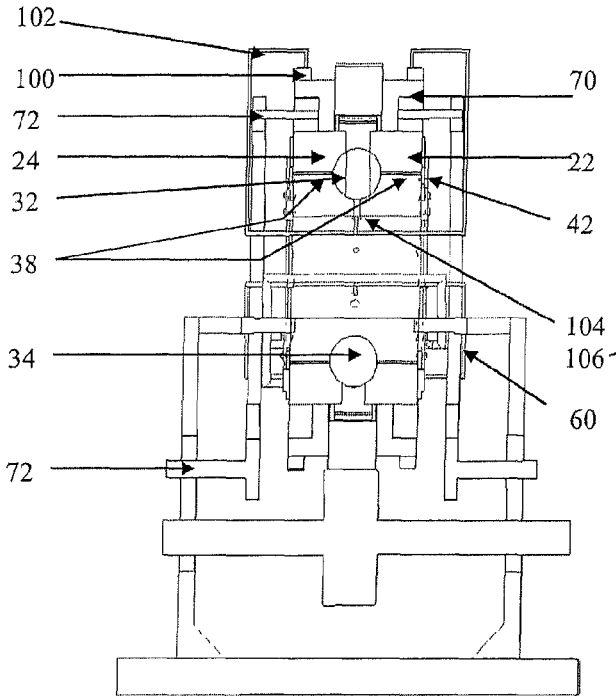
FIG. 2(*a*) illustrates an exemplary embodiment of the present invention depicting sectional front view of assembly of the embodiments.
Figure 2:
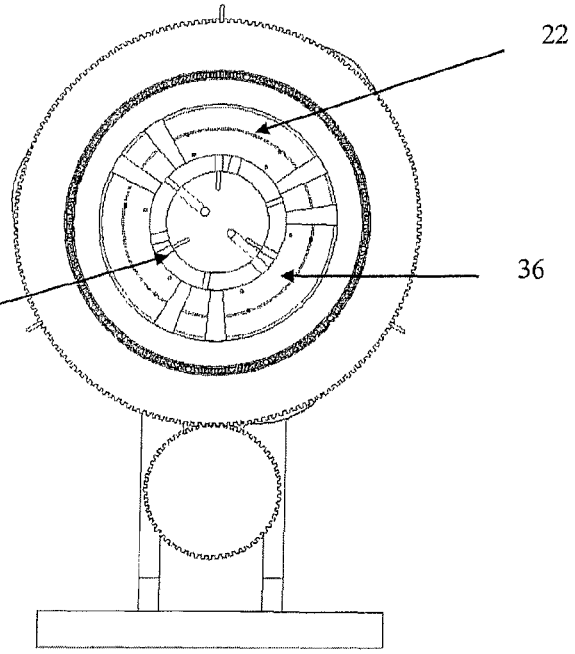

As shown in FIGS. 2(*a*) and 2(*b*), the first timing device (60) reads the angular position of the vanes (40) reflected through the projected surface (68) of the profiled element (64) and actuates the bi-purpose coupling (70) through first gearing arrangement (72). The first gearing arrangement (72) is an epicyclic gearing arrangement, which engages the bi-purpose coupling (70) with the individual constituent (21) and facilitates a control on relative motion between them. The common transmission element (120) can take the power from Drive Element (90) or can drive the drive element (90) to give the power as an output. Further, there are actuating linkages (102) that reads the cam profile on outer side of the bi purpose coupling (70) and actuates the fluid exchange accessories (104) in a way similar to conventional engines.

Further, the sealing element (42) seals the seam lines (38) between intermittent rotor element (20) and the stator elements (50) to prevent leakage of inside fluid supplied by the fluid exchange accessories (104). The sealing element (42) also seal the gap between circumferential face of the vanes (40) and the inner surface (26) of the torus chamber and prevent the leakage between the two adjacent second volumes (36).

Figure 3:
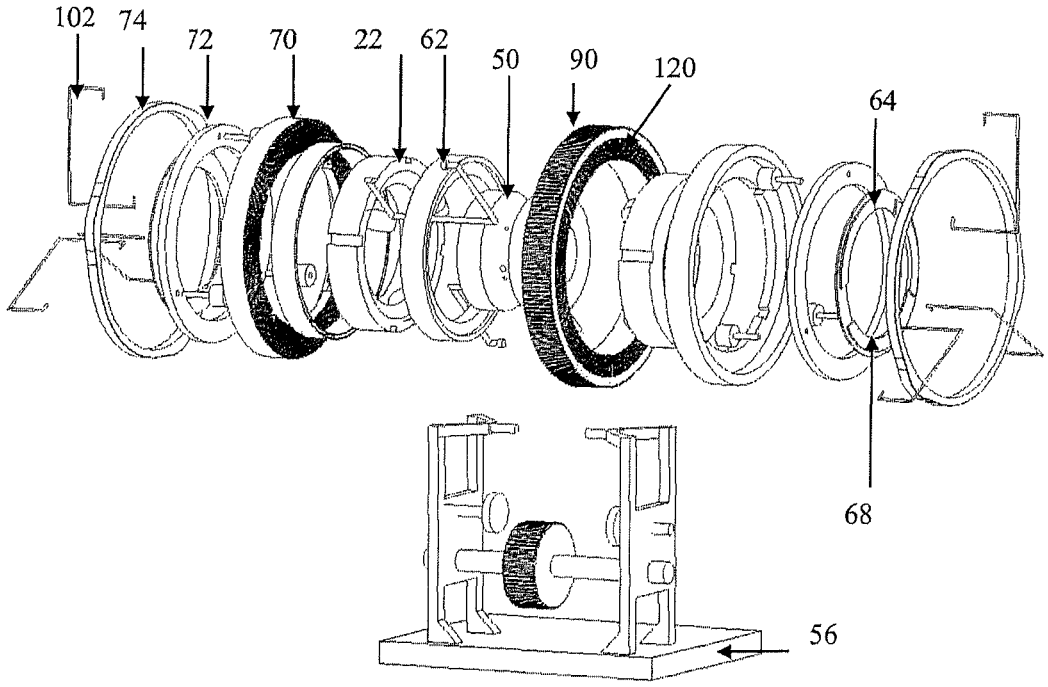
FIG. 3 illustrates an exemplary embodiment of the present invention depicting an exploded view of assembly of the embodiments.

As shown in FIG. 3, the stator element (50) is structurally supported by frame (52) on the base (56). The intermittent rotor element (20) is inserted on the stator element (50) such that inner surfaces (26) of intermittent rotor element (20) i.e. of individual constituent (22) and its counterpart (24) forms the first part (30) of the torus chamber surface. The second part (32) of the torus chamber surface is formed by the surface of the stator element. This first part (30) along with the second part (32) forms the first volume (34), which is the complete volume of the torus chamber, which further encloses vanes (40).

Figure 4:
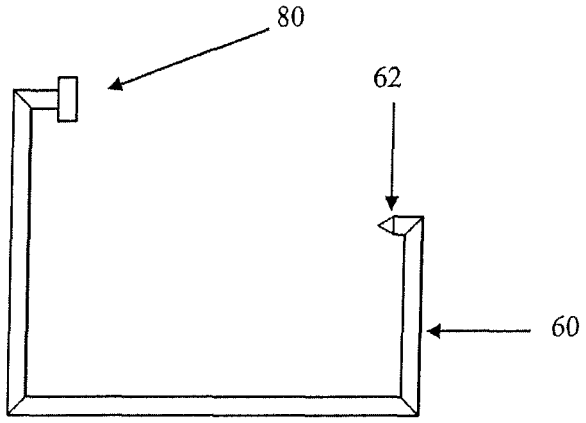
FIG. 4 illustrates an exemplary embodiment of the present invention depicting front view of the follower and control link.

As shown in FIG. 4, the first timing device (60) constitutes of control link (80) to actuate bi-purpose coupling (70) after reading the angular position of the vane reflected through the projected surface (68) by a follower (62).

As shown in FIG. 5(*a*) and FIG. 5(*b*), the individual constituent (21) and its counterpart (24) comprises of circular disc (22) fitted with three vanes (40). These vanes are overhanging, radial and concentric such that each of the circular discs (22) has equal number of the vanes (40). These vanes (40) divide the first volume (34), which is the complete volume enclosed by the individual constituents (21) and its counterpart (24) in to a number of second volumes (36), which is equal to the total no. of vanes (40).

Further, the angular position of the vanes is determined by the sequence of events in the mechanism, which includes vane rotation, which further constitutes of first period and a second period. In first period the vanes (40) rotate with a constant angle between them and in second period the vanes (40) on one circular disc (22) i.e. either of individual constituent (21) or its counterpart (24) is held stationary by first timing device and other circular disc (22) rotates till it achieve the desired constant angle with next adjacent counter vane. Again the first period starts when the vanes (40) on the circular disc (22) of both the individual constituents (21) and its counterpart (24) moves with the constant angle, followed by second period where, the circular disc of either the individual constituents (21) or its counterpart (24), which was rotating in previous second period is held stationary by first timing device (60) and the other circular disc (22) which was stationary in the previous second period is allowed to rotate. Accordingly, the sequence of events in the mechanism continues, thereby leading to alternate increase and decrease of the second volumes (36) entrapped between the vanes due to alternate rotation of either individual constituents (21) or its counterpart (24) and simultaneously decreasing and increasing of volumes on both sides of the vanes (40) during second period. The second volumes (36) remain constant during the first period. The changing nature of second volumes (36) can be used to perform sequential compression and expansion, thus the mechanism achieves a thermodynamic cycle. The variation of time by varying the angular position of the vanes resulting in first period and second period results in multivane roto-dynamic variable displacement machine.

As shown in FIG. 5(*c*), the profiled element (64) of the first timing device (60) is a face cam having projected surface which is read by the follower (62). The follower (62) rides on the projected surface to read the surface variations, one for each individual constituent (21) or the counterpart (24). The projected surface makes a second projected angle ($\gamma$) at the center of the individual constituents (21). The second projected angle ($\gamma$) exceeds a first projected angle ($\alpha$) of one of the vanes (40) is the angle made between adjacent vanes on the center of the circular discs (22). And the angle subtended by the vanes at the center of the individual constituents (21) is $\beta$ which along with first projected angle ($\alpha$) forms the second projected angle ($\gamma$). The position of profiled element (64) and the follower (62) is dependent on its respective individual constituents (21) or the counterpart (24), such that the variations at the projected surfaces, which relay the position of the vanes (40) and the positional dependency ensures that the counterpart (24) is either engaged or disengaged by its respective bi-purpose coupling (70). The bi-purpose coupling (70) on one side is actuated by the follower (62) responding to the projected surface (68) of profiled element (64) whereas on the other side is fixed at desired angular position with individual constituents (21) or the counterpart (24). The variation of the second projected angle (γ) varies the point of actuation of the bi-purpose coupling (70), thereby resulting in displacement of the follower (62) in a radial direction where the projected angle variation leads to the actuation of the bi-purpose coupling (70) at a position corresponding to the varied position of the surface by the projected surface. The second projected angle (γ) variation results either in delay or in earlier actuation of bi-purpose coupling (70). Thereby resulting in the mechanism to work as a variable displacement machine.

Further, the projected surface (68) and the follower (62) of the respective Individual constituent (21) actuate its counterpart (24) as many times as the total number of vanes (40) during one rotation of the individual constituents, or the projected surface (68) and the follower (62) of the respective counterpart (24) actuate its individual constituents (21) as many times as the total number of vanes (40) during one rotation of the counterpart (24). This is possible by having one projected surface for each vanes (40) and one follower, during one rotation.

In an alternate embodiment, there can be one projected surface (68) and one follower (62) for each vane for above described mechanism for one rotation.

In an alternate embodiment, there can be one or more than one projected surface (68) and one or more than one follower (62) that provide as many number of actuations as there are vanes on their respective individual constituents (21) or the counterpart (24) during one rotation.

In an alternate embodiment the bi-purpose coupling is a combination of first gearing arrangement (72) and second gearing arrangement (74), which forms the links of rotating pairs as shown in FIG. 1 and FIG. 3, that varies the speed ratio between individual constituents (21) or its counterpart and the drive element (90), resulting in angular rotation of either an equal magnitude or of an unequal magnitude. The first gearing arrangement (72) provides variable speed ratio between bi-purpose coupling and individual constituents (21) or its counterpart (24) whereas second gearing arrangement (74) provides external feed control over first gearing arrangement (72). This facilitates variable compression and expansion rates on both sides of the moving vanes (40) resulting in varying rate of alternate increase and decrease of the second volumes (36) entrapped between the vanes (40) and simulaneously decrease and increase of second volumes (36) on both sides of vanes (40), except at times when the angular velocities of the individual constituent (21) is of equal magnitude i.e. for the first period when the second volumes (36) remains constant, as discussed above, and hence results in the thermodynamic cycles.

In an alternate embodiment, the bi-purpose coupling is externally engaged with a common transmission element (120) as shown in FIG. 3. The common transmission element (120) can take the power from drive element (90) or can drive the drive element (90) based on various applications for example engine, compressor etc.

In an alternate embodiment the fluid exchange accessories (104) as shown in FIG. 2(*a*), the fluid exchange accessories (104) exchanges the fluid between the second volumes (36) and the volumes outside the torus chamber surface. The fluid exchange accessories (104) comprise a second timing device (100), which is a cam with a cam profiles and the follower (62) in the mechanism, which actuates the fluid exchange accessories (104). The cam profiles are on the outer periphery of the bi-purpose coupling and read by the Actuating Linkage (102) and it actuates the mechanism for allowing fluid exchange between the second volumes (36) and volumes outside torus chamber surface. The cam position is such that the actuating linkages (102) reads the vane position of respective individual constituents (21) or the counterpart (24) as discussed earlier.

In an alternate embodiment, the energy exchange accessories (106) as shown in FIG. 2(*b*), the energy exchange accessories (106) allows energy exchange between the second volumes (36) and the volumes outside the torus chamber surface. The actuation of the energy exchange accessories (106) is provided by second timing device (100), where there can be one actuating linkage (102) and more than one projected surfaces (68) on respective cam or one projected surfaces (68) on the cam and more than one actuating linkage (102).

In an alternate embodiment, the drive element (90) is either placed concentric or non-concentric with the central axis. Whenever the drive element (90) is non concentric, it is engaged to bi-purpose couplings (70) through one or more than one common transmission element (120).

I claim:

1. A multiple vane roto-dynamic variable displacement kinetic system with a mechanism comprising:

an intermittent rotor element containing plurality of, an individual constituents along with a counterpart, wherein said individual constituents and said counterpart has a circular disc, placed coaxially with a central axis of said intermittent rotor element such that each of said individual constituents has an inner surface that together with the inner surface of said counterpart forms a first part of a torus chamber surface wherein said circular disc are fitted with plurality of overhanging, radial and concentric vanes such that each of said circular disc have equal number of said vanes;

a drive element which is a continually rotating link of said mechanism when operating and either serves for power input or power take off;

at least a stator element that forms a part of a structural element to support said intermittent rotor element with its surface forming a second part of said torus chamber surface that along with said first part forms a first volume that encloses said vanes, wherein said first volume is partition into plurality of second volumes equal to the total number of vanes on said circular disc, a bi-purpose coupling for engaging and disengaging said individual constituents alternately with at least any one of said drive element and said structural element, through said bi-purpose coupling depending upon a signal provided by a control link actuated by a first timing device, such that there is at least one said first timing device for each said individual constituent wherein said first timing device of said individual constituent actuates said bi-purpose coupling of said counterpart, wherein said first timing device reads the angular position of said vanes and actuates said bi-purpose coupling at a desired angular position from said counterpart for rendering said counterpart either as fixed link or as rotating link, allowing said circular discs to perform a sequence wherein said individual constituents are rotating link of said mechanism for a first period, which is preceded and succeeded by a second period wherein either of said individual constituents is alternately a part of fixed link of said mechanism, while said counterpart is rotating link of said mechanism, thus leading to alternate increase and decrease of said second volumes entrapped between said vanes, and simultaneously decreasing and increasing on both sides of said vanes respectively, keeping said second volumes constant for said first period, wherein, the changes in said second volumes are utilized for compression and expansion processes of thermodynamic cycles in fluid handling machines and the variation in time period of said first period and said second period by varying said desired angular position results in said multivane roto-dynamic variable displacement kinetic system.

2. The multiple vane roto-dynamic variable displacement kinetic system with a mechanism as claimed in claim 1, wherein said individual constituents and said drive elements are links of rotating pairs that enable variable speed ratios between said individual constituents and said drive elements resulting in angular rotation of either an unequal magnitude or of an equal magnitude, thus leading to varying rate of alternate increase and decrease of said second volumes entrapped between said vanes, and simultaneously decreasing and increasing on both sides of said vanes respectively, except at times when the angular velocities of said individual constituents is of said equal magnitude and thus keeping said second volumes constant for said first period.

3. The multiple vane roto-dynamic variable displacement kinetic system with a mechanism as claimed in claim 1, wherein said drive element is placed concentric with said central axis.

4. The multiple vane roto-dynamic variable displacement kinetic system with a mechanism as claimed in claim 1, wherein said drive element is placed non concentric, with said central axis, wherein when said drive element being non concentric, is engaged to bi-purpose couplings through at least a common transmission element.

5. The multiple vane roto-dynamic variable displacement kinetic system with a mechanism as claimed in claim 1, wherein said first timing device comprises, a profiled element along with a follower that rides on a surface and reads a surface variation, one for each said individual constituents and driven by said individual constituents, wherein said profiled element has at least a projected surface with a second projected angle ($\gamma$) on the center of said Individual Constituents such that said second projected angle ($\gamma$) exceeds a first projected angle ($\alpha$) by projected angle ($\beta$) of one of said vanes on the center of said circular discs, wherein said profiled element and said follower have a positional dependency with its respective said individual constituents, such that variation at said projected surfaces, which relay the position of said vanes on its said individual constituent and said positional dependency ensures that said counterpart is engaged and disengaged by its respective said bi-purpose Coupling, actuated by said follower responding to variation on the surface due to said projected surface at said desired angular position of its respective said individual constituent with respect to said counterpart and the variation of said projected angle varies the point of actuation of said bi-purpose coupling, wherein displacing the follower in a direction where the projected angle variation leads to said actuation of bi-purpose coupling at a position corresponding to the varied position of variation of the surface by said projected surface, thence resulting in mechanism working as a variable displacement machine, wherein said projected surfaces and said follower of respective said individual constituent actuate its said counterpart as many times as the number of said vanes during one rotation of said individual constituent either by said projected surface one for each said vanes and one follower or by one said projected surface and said follower one for each said vanes or by such number of said projected surface and said follower that provide as many number of actuations as there are said vanes on its respective said individual constituent during one rotation.

6. The multiple vane roto-dynamic variable displacement kinetic system with a mechanism as claimed in claim 1, wherein a seam lines on the torus chamber surface formed at the end surface of said intermittent rotor element and said stator elements are provided with a sealing element so that spaces between said vanes inside the torus chamber surface are sealed from spaces outside the torus chamber surface and similarly sealing arrangements on a circumferential surface of said vanes for sealing fluid leaking past the circumferential surface of said vanes.

7. The multiple vane roto-dynamic variable displacement kinetic system with a mechanism as claimed in claim 1, wherein at least a fluid exchange accessories is fitted on elements of said mechanism for allowing fluid exchange between said second volume and volumes outside said torus chamber surface, wherein said fluid exchange accessories comprises a second timing device with a positional dependency with its respective said individual constituents.

8. The multiple vane roto-dynamic variable displacement kinetic system with a mechanism as claimed in claim 1, wherein at least an energy exchange accessories is fitted on elements of said mechanism for allowing energy exchange between said second volume and volumes outside said torus chamber surface.

* * * * *